US006398439B1

(12) United States Patent
Szekely

(10) Patent No.: US 6,398,439 B1
(45) Date of Patent: Jun. 4, 2002

(54) OVAL ROTARY DISPENSER WITH PRESSURE RELIEF

(75) Inventor: Alex Szekely, Jackson, NJ (US)

(73) Assignee: The Plastek Group, Erie, PA (US)

( * ) Notice: Subject to any disclaimer, the term of this patent is extended or adjusted under 35 U.S.C. 154(b) by 0 days.

(21) Appl. No.: 09/928,603

(22) Filed: Aug. 13, 2001

(51) Int. Cl.[7] ..... A45D 40/04

(52) U.S. Cl. ..... 401/79; 401/175; 401/266; 401/75

(58) Field of Search ..... 401/79, 75, 68, 401/266, 175, 172, 173, 179, 265; 222/491, 492, 495, 496

(56) References Cited

U.S. PATENT DOCUMENTS

| | | | | |
|---|---|---|---|---|
| 3,756,730 A | | 9/1973 | Spatz | |
| 4,865,231 A | | 9/1989 | Wiercinski | |
| 5,000,356 A | | 3/1991 | Johnson et al. | |
| 5,697,531 A | | 12/1997 | Fattori | |
| 5,725,133 A | | 3/1998 | Iaia | |
| 5,839,622 A | | 11/1998 | Bicknell et al. | |
| 5,879,096 A | | 3/1999 | Franta et al. | |
| 6,086,276 A | * | 7/2000 | Gueret | 401/75 |
| 6,116,803 A | | 9/2000 | Szekely et al. | |
| 6,210,061 B1 | * | 4/2001 | Johnson | 401/175 |

FOREIGN PATENT DOCUMENTS

| | | |
|---|---|---|
| EP | 0 312 165 | 4/1989 |

* cited by examiner

*Primary Examiner*—David J. Walczak
(74) *Attorney, Agent, or Firm*—Bachman & LaPointe, P.C.

(57) ABSTRACT

A rotary dispenser with internal pressure relief includes a housing; an elevator slidably and non-rotatably disposed in the housing; a rotatable drive member rotatably disposed in the housing and engaged with the elevator whereby rotation of the drive member slides the elevator relative to the housing; a dome slidably and non-rotatably mounted relative to the housing and having at least one aperture for dispensing product from inside of the housing; and a pressure relief member having a cam and a cam follower, one of the cam and the cam follower being associated with the rotatable drive member and the other of the cam and the cam follower being associated with the dome, the cam follower being rotatably engaged with the cam, whereby rotation of the rotatable drive member relative to the dome rotates one of the cam and the cam follower relative to the other of the cam and the cam follower, the cam having at least one cam surface for causing axial movement of the dome toward the elevator and at least one second cam surface for allowing movement of the dome away from the elevator.

12 Claims, 1 Drawing Sheet

OVAL ROTARY DISPENSER WITH PRESSURE RELIEF

BACKGROUND OF THE INVENTION

The invention relates to a rotary dispenser for dispensing deodorants, cremes, gels and the like, and is particularly drawn to dispenser of such products wherein the products are sensitive to pressure.

In the deodorant industry, one popular form of the product is a creme or gel which is dispensed from a dispenser through rotary, pushup or other mechanisms which force material out of an applicator portion, typically an apertured applicator surface. Such compositions are quite sensitive to pressure and, small increases beyond atmospheric pressure can lead to breaking down of the composition. Further, the structure of typical dispensers allow for additional products to continue to dispense from the dispenser or weep after use as a result of remaining excess pressure within the housing.

A number of attempts have been made to address this issue. For example, U.S. Pat. No. 6,116,803 to Szekely, discloses a dispenser wherein the applicator surface is positioned on a "dome" which floats, or can move relative to the housing, such that after use any internal pressure biases the dome upwardly to relieve same.

Numerous other efforts have been made to provide mechanisms whereby internal increased pressure can be relieved. These mechanisms are drawn to a partial withdrawing of an elevator mechanism within the housing that is conventionally used to drive the product.

Although some of these mechanisms do provide relief of pressure, the need remains for an effective and reliable structure whereby internal pressure is relieved. This need extends to a mechanism which is simple and acceptable to the consumer, and which is not problematic during manufacture of the package and/or filling of the product.

It is therefore the primary object of the present invention to provide such a dispenser.

Other objects and advantages of the present invention will appear hereinbelow.

SUMMARY OF THE INVENTION

In accordance with the present invention, the foregoing objects and advantages have been readily attained.

According to the invention, a rotary dispenser is provided having internal pressure relief, and this dispenser comprises a housing; an elevator slidably and non-rotatably disposed in said housing; a rotatable drive member rotatably disposed in said housing and engaged with said elevator whereby rotation of said drive member slides said elevator relative to said housing;

a dome slidably and non-rotatably mounted relative to said housing and having at least one aperture for dispensing product from inside of said housing; and a pressure relief member comprising a cam and a cam follower, one of said cam and said cam follower being associated with said rotatable drive member and the other of said cam and said cam follower being associated with said dome, said cam follower being rotatably engaged with said cam, whereby rotation of said rotatable drive member relative to said dome rotates one of said cam and said cam follower relative to the other of said cam and said cam follower, said cam having at least one first cam surface for causing axial movement of said dome toward said elevator and at least one second cam surface for allowing movement of said dome away from said elevator.

In accordance with a further aspect of the present invention, a rotary dispenser is provided having internal pressure relief, wherein the dispenser comprises a housing; an elevator slidably and non-rotatably disposed in said housing; a rotatable drive member rotatably disposed in said housing and engaged with said elevator whereby rotation of said drive member slides said elevator relative to said housing; a dome slidably and non-rotatably mounted relative to said housing and having at least one aperture for dispensing product from inside of said housing; and means associated between said rotatable drive member and said dome for sequentially moving said dome toward said elevator and away from said elevator responsive to rotation of said rotatable drive member.

BRIEF DESCRIPTION OF THE DRAWINGS

A detailed description of preferred embodiments of the present invention follows, with reference to the attached drawings, wherein.

DETAILED DESCRIPTION

Figure 1:
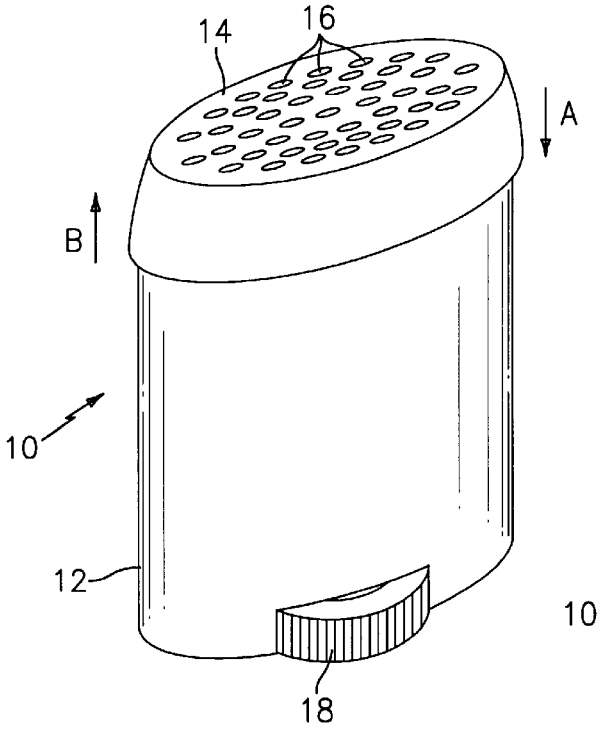
FIG. 1 is a perspective view of a dispenser in accordance with the present invention.

The invention relates to a rotary dispenser having a mechanism for providing relief of internal pressure following use. FIG. 1 shows a perspective view of a dispenser 10 of the rotary type. As shown in FIG. 1, dispenser 10 has a housing typically having an oval shaped cross section, and a dome 14 positioned on the housing and having a plurality of apertures 16 wherein the dome includes a central applicator surface and a sleeve portion extending from the applicator surface and slidably engaging the housing. A dispensing mechanism is positioned within housing 12, of which a wheel member 18 is visible in FIG. 1, and this dispensing mechanism is actuated by rotating wheel member 18 so as to dispense product such as creme or gel deodorant and the like through apertures 16 for application to a desired surface.

The invention is drawn to a particular structure of the drive member which advantageously provides for a sequential movement of dome 14 relative to housing 12 first downwardly as shown by arrow A and then upwardly as shown by arrow B. This sequential movement is accomplished by rotating wheel member 18 and helps to dispense product through aperture 16 when desired and then release pressure on internal product after dispensing a certain amount of product through apertures 16 so as to avoid problems associated with excess internal pressure.

As set forth above, this excess internal pressure can adversely affect many cosmetic gels and cremes such as deodorants and the like, causing them to break down into their constituent components, and can also cause messy and undesirable weeping of product through aperture 16 after use.

Figure 2:
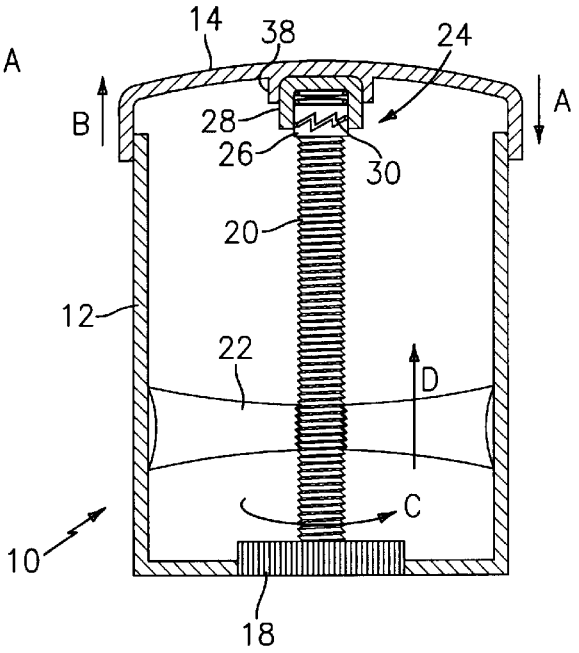
FIG. 2 is a partially cross-sectional view of a dispenser in accordance with the present invention.

Turning now to FIG. 2, the mechanism of the present invention is further illustrated.

As shown in FIG. 2, dispensing of product from dispenser 10 is actuated through a rotatable drive member 20, in this case a threaded rod, which is secured to and rotatable with wheel member 18, and an elevator member 22 which is disposed within housing 12 in sliding but substantially sealing engagement with an inner wall surface of housing 12, and engaged with rotatable drive member 20 such that rotation of rotatable drive member 20 moves elevator member 22 along rotatable drive member 20 so as to force product upwards within housing 12 and through aperture 16 to the outer surface of dome 14 as desired.

In accordance with the present invention, an assembly 24 is provided and associated between dome 14 and rotatable drive member 20 so as to cause sequential downward and upward movement of dome 14 relative to housing 12 and elevator member 22 as desired. Assembly 24 in accordance with the present invention includes a cam portion 26 and a cam follower portion 28. In the embodiment shown in FIGS. 2 and 3, cam portion 26 is connected to rotatable drive member 20 and has a slot 30 which defines first cam surfaces 32 angled to drive dome 14 downwardly and toward elevator member 22 and second cam surfaces 34 angled to allow dome 14 to move upwardly and away from elevator 22 as desired. In this regard, second cam surfaces 34 are preferably substantially vertical so that pressure is relieved rapidly, without the need for further turning of drive member 20.

Figure 3:
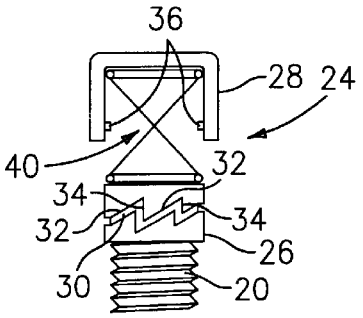
FIG. 3 is an enlarged view of a portion of the dispenser of FIG. 2.

In the embodiment shown in FIGS. 2 and 3, cam portion 26 is a substantially round member, and slot 30 is defined around the outer periphery of the round member so as to define a plurality of first and second cam surfaces. Of course, any number of cam surfaces could be provided around this periphery, from one and upwards to as many as would be practical, depending upon the frequency of the cycle of movement of dome 14 which is desired in the course of a single rotation of rotatable drive member 20, and the member of engaging structures desired for stability of operation.

In accordance with the present invention, cam follower 28 may suitably be provided as a round member having one or more projections or protrusions 36 adapted to engage surfaces 32, 34, for example by extending into slot 30, such that rotation of cam portion 26 relative to cam follower 28 with projection 36 engaged in slot 30 results in cyclical upward and downward movement of cam follower relative to cam portion 26. Cam follower 28 in this embodiment is fixedly engaged with dome 14, for example by mounting within a downwardly depending sleeve structure 38, such that this motion of cam follower 28 is imparted to dome 14 as desired.

In further accordance with the present invention, and as best shown in FIG. 3, a biasing member 40 is advantageously positioned between cam portion 26 and cam follower 28 so as to exert an upward force on cam follower 28 so as to assist in moving cam follower 28 and dome 14 upwardly when projection 36 is aligned with second cam surfaces 34 as desired. Any suitable spring or other biasing member can be used in this regard.

In operation, and referring to FIG. 2, rotation of rotatable member 20 as shown by arrow C causes elevator member 22 to move upwardly as shown by arrow D and simultaneously drives assembly 24 to cause dome 14 to move downwardly as shown by arrow A followed by upward motion as shown by arrow B so as to dispense product and then release pressure as desired.

It should of course be appreciated that cam portion 26 and cam follower 28 can be arranged in the inverse relationship, that is, with the cam portion fixed to dome 14 and the cam follower fixed to rotatable drive member 20, well within the scope of the present invention. In such a configuration, for example, cam portion 26 could be provided as a cap-shaped member as shown in FIGS. 2 and 3 with a slot defined on an inner surface thereof, while cam follower 28 could be provided as a substantially round member having an outwardly extending projection for engaging the slot. It should be readily apparent that this would function substantially the same way to provide the same result as desired in accordance with the present invention.

The apparatus of the present invention advantageously serves to increase delivery of product through aperture 16 during rotation of wheel member 18 as desired, so as to provide for more rapid dispensing which would be desirable to consumers, and further provides for immediate release of internal pressure accompanied by an audible and noticeable click when projection 36 reaches second cam surface 34 and moves upwardly so as to signal to a user that a suitable amount of product has been dispensed through apertures 16.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A rotary dispenser with internal pressure relief, comprising a housing;

an elevator slidably and non-rotatably disposed in said housing;

a rotatable drive member rotatably disposed in said housing and engaged with said elevator whereby rotation of said drive member slides said elevator relative to said housing;

a dome slidably and non-rotatably mounted relative to said housing and having at least one aperture for dispensing product from inside of said housing; and a pressure relief member comprising a cam and a cam follower, one of said cam and said cam follower being associated with said rotatable drive member and the other of said cam and said cam follower being associated with said dome, said cam follower being rotatably engaged with said cam, whereby rotation of said rotatable drive member relative to said dome rotates one of said cam and said cam follower relative to the other of said cam and said cam follower, said cam having at least one cam surface for causing axial movement of said dome toward said elevator and at least one second cam surface for allowing movement of said dome away from said elevator.

2. The dispenser of claim 1, wherein said housing has a substantially oval-shaped cross section.

3. The dispenser of claim 1, further comprising a biasing member for exerting a force on said dome for moving said dome away from said elevator when said cam follower is aligned with said at least one second cam surface.

4. The dispenser of claim 3, wherein said biasing member exerts said force on said dome through one of said cam and said cam follower.

5. The dispenser of claim 3, wherein said biasing member is positioned between said cam and said cam follower.

6. The dispenser of claim 1, wherein said dome has a central applicator surface and a sleeve portion extending from said applicator surface and slidably engaging said housing.

7. The dispenser of claim 1, wherein said cam comprises a first round member having a slot disposed therein, said slot defining said at least one first cam surface and said at least one second surface, and wherein said cam follower comprises a second round member adapted to rotate relative to said first round member and having at lease one projection engaging said slot.

8. The dispenser of claim 7, wherein one of said first and second members is fixed relative to said dome and the other of said first and second member is fixed relative to said rotatable drive member.

9. The dispense of claim 8, wherein said dome has an inner surface and a mounting sleeve extending from said inner surface, and wherein said one of said first and second member is mounted in said mounting sleeve.

10. The dispenser of claim 1, wherein said rotatable drive member is rotatably engaged with said elevator whereby rotation of said rotatable drive member relative to said elevator moves said elevator along said rotatable drive member.

11. The dispenser of claim 1, further comprising a product contained in said housing, said product comprising a substance which is adversely affected by increases in pressure.

12. A rotary dispenser with internal pressure relief, comprising:

a housing;

an elevator slidably and non-rotatably disposed in said housing;

a rotatable drive member rotatably disposed in said housing and engaged with said elevator whereby rotation of said drive member slides said elevator relative to said housing;

a dome slidably and non-rotatably mounted relative to said housing and having at least one aperture for dispensing product from inside of said housing; and means associated between said rotatable drive member and said dome for sequentially moving said dome toward said elevator and away from said elevator responsive to rotation of said rotatable drive member.

* * * * *